United States Patent [19]

Kurata et al.

[11] Patent Number: 4,654,108

[45] Date of Patent: Mar. 31, 1987

[54] UNIT TILE PACK MANUFACTURING APPARATUS

[75] Inventors: Ikuro Kurata; Hideaki Hayashi, both of Tajimi; Kazumi Sugiyama, Kasugai; Kunihiko Kuboi, Tokoname, all of Japan

[73] Assignee: Inax Corporation, Aichi, Japan

[21] Appl. No.: 810,928

[22] Filed: Dec. 19, 1985

[30] Foreign Application Priority Data

Jan. 18, 1985 [JP] Japan ..... 60-7953
Jun. 20, 1985 [JP] Japan ..... 60-133060

[51] Int. Cl.[4] ..... B32B 31/00

[52] U.S. Cl. ..... 156/561; 156/297; 156/562

[58] Field of Search ..... 156/558–562, 156/297, 556, 552; 29/784

[56] References Cited

U.S. PATENT DOCUMENTS 3,162,937 12/1964 Schweiker ..... 156/561 X
3,177,568 4/1965 Schweiker ..... 156/561 X
3,181,987 5/1965 Polevitzky ..... 156/562
3,291,676 12/1966 Watson ..... 156/561
3,298,886 1/1967 Vevoda ..... 156/562 X
3,322,591 5/1967 Cleverly ..... 156/562 X
3,463,695 8/1969 Schweiker ..... 156/562 X

*Primary Examiner*—David Simmons
*Attorney, Agent, or Firm*—Michael N. Meller

[57] ABSTRACT

The invention relates to an unit tile pack manufacturing apparatus. The apparatus comprises a tile pack conveying passage (8) for conveying a plurality of pallets (9), a combination tile pack forming unit (100), a joint alignment correcting unit (15), an adhesive dropping unit (30), and a connecting sheet supplying and pressing unit (45). These units (100, 15, 30 and 45) are disposed along the tile pack conveying passage (8). In the combination tile pack forming unit (100) a plurality of tiles of different tones of the same color or a plurality of tiles of different color are arranged side by side in lines and rows. The adhesive dropping unit (30) includes adhesive dropping nozzles (35) disposed at a predetermined interval from the tiles and intermittently dropping an adhesive on the upper surface of each of the tiles at positions close to the side adjacent to corresponding positions of the adjacent tiles. The unit tile pack is formed in the respective pallet while passing through the connecting sheet supplying and pressing unit (45).

1 Claim, 15 Drawing Figures

Fig. 9

| OPERATING SEQUENCE | | | 1 | 2 | 3 | 4 | 5 | 6 | 7 | 8 | 9 |
|---|---|---|---|---|---|---|---|---|---|---|---|
| STOPPING DEVICE | $S_1$ | I | o | | | | | | | | o |
| | $S_2$ | II | | o | | o | | o | | o | |
| | $S_3$ | III | | | o | | o | | o | | |

Fig. 10

| | | |
|---|---|---|
| I | II | III |
| II | III | II |
| III | II | I |

| | | |
|---|---|---|
| I | II | III |
| II | III | II |
| III | II | I |

| | | |
|---|---|---|
| I | II | III |
| II | III | II |
| III | II | I |

UNIT TILE PACK MANUFACTURING APPARATUS

BACKGROUND OF THE INVENTION

1. Field of the Invention

The present invention relates to a unit tile pack manufacturing apparatus for continuously manufacturing unit tile packs each having a plurality of tiles with joints therebetween and interconnected by connecting sheets. More specifically, the present invention relates to a unit tile pack manufacturing apparatus for continuously manufacturing combination unit tile packs, i.e., unit tile packs each having a plurality of arranged tiles.

Note, the term "unit tile pack" denotes an aggregate of a plurality of tiles formed by arranging the tiles in lines and rows with straight longitudinal and lateral joints therebetween and applying a connecting sheet to the front or back of the aggregate. Such a unit tile pack facilitates manual tile work.

2. Description of the Related Art

Conventional tile pack manufacturing apparatuses for manufacturing unit tile packs have been proposed, which comprise mechanisms including an adhesive applying unit and a connecting sheet supplying unit disposed along the tile conveying direction of a tile conveying passage. The adhesive applying unit applies an adhesive over the upper surface or on part of the upper surface of tiles aligned with joints therebetween. The connecting sheet supplying unit supplies connecting sheets to the tiles at points where the adhesive is applied in order to interconnect the adjacent tiles.

In such a conventional unit tile pack manufacturing apparatus, the various problems that occur usually originate in the adhesive applying unit, and hence, the adhesive applying unit is a source of undesirable stoppages in the flow of a tile pack manufacturing line. For example, in the conventional adhesive applying unit, plurality of tiles are conveyed along a tile conveying passage in a pallet having tile receiving pockets for holding the tiles in edge-alignment. The application roller of the adhesive applying unit comes into contact with the entire area of the surface of each of the tiles aligned in the tile receiving pocket to apply an adhesive to the surfaces of the tiles. However, since tiles are maunufactured through a plurality of heating processes having different temperature levels, such as burning and drying, errors in the size of the tiles including thickness, occur. Therefore, when the tiles are disposed in place in the pallet, the upper surfaces of the tiles are not flush and form an irregular plane. Accordingly, each of the tiles comes into contact with the application roller to a varying degree, and hence it is impossible to apply the adhesive to the surfaces of the tiles as a film having a uniform thickness. Furthermore, the size of the tile receiving pockets of the pallet is slightly greater than the maximum external size of the tiles. Accordingly, the tiles are disarranged, i.e., not correctly edge-aligned, when the adhesive is applied to the upper surfaces of the tiles by the application roller. Therefore, in the conventional unit tile packet manufacturing process, it is necessary to check and correct the arrangement of the tiles both before and after the application of the adhesive.

To eliminate the above drawbacks, an adhesive applying mechanism was proposed having a lifting board capable of moving vertically in an area above a tile conveying passage and in an area above an adhesive tank disposed beside the tile conveying passage. This adhesive applying mechanism applies an adhesive to the tiles by absorbing adhesive contained in the adhesive tank and then bringing the adhesive into contact with a tile pack after moving the tile pack on the tile conveying passage. However, this adhesive applying mechanism still applies an adhesive to tiles through contact with the tiles, and thus is unable to eliminate all of the drawbacks of the above-mentioned adhesive applying unit. Furthermore, since the surface of the adhesive contained in the adhesive tank is exposed to the atmosphere, this adhesive applying mechanism has another drawback in that the surface of the adhesive contained in the adhesive tank hardens. Still further, since the adhesive tank must be disposed beside the tile conveying passage, a wide floor space is required for the installation thereof. Furthermore, the tile conveying passage must be stopped while the lifting board moves between the adhesive tank and the tile conveying passage and therefore, the overall operating efficiency of the unit tile pack manufacturing apparatus including this adhesive applying mechanism is extremely low.

Also, in the manufacture of tile packs, unit tile packs are classified into pattern unit tile packs and solid color unit tile packs. In particular, solid color unit tile packs of the same solid color suffer from variation in color tone due to various causes, such as variation of the material in particle size distribution, variation of the material due to segregation in the hopper, or differences between the positions of tiles in the kiln.

Accordingly, if unit tile packs consisting of tiles of different lots differing from each other in color tone but of the same basic color, are laid over a wide area, such as a ceiling, wall or floor of a building, this wide area varies in color tone from section to section which deteriorates the aesthetic appearance of the area.

The usual procedure for obviating this deterioration of aesthetic appearance is to form a unit tile pack by manually selecting individual tiles from different lots and arranging the selected tiles in the form of a unit tile pack; which procedure is inefficient and requires a high degree of skill.

SUMMARY OF THE INVENTION

Accordingly, it is an object of the present invention to provide a novel unit tile pack manufacturing apparatus (referred to as "an apparatus of the present invention" hereinafter) by which the drawbacks of the conventional adhesive applying mechanisms are eliminated and having an improved operating efficiency.

It is an another object of the present invention to provide a simple combination tile pack forming unit, capable of replacing the manual processing of forming combination tile packs.

The present invention provides an unit tile pack manufacturing apparatus comprising, A tile pack conveying passage having a tile pack supplying section at one end and a unit tile pack delivering section at the other end; a plurality of pallets each having tile receiving pockets for holding a plurality of tiles in a relatively loose fashion and being conveyed along the tile pack conveying passage; a combination tile pack forming unit having a classifying device for classifying a plurality of tiles of different tones of the same color, or a plurality of different colors into a plurality of groups by tone, or a plurality of groups by color, a delivery device for delivering tile from each group to a feeding device in order according to a predetermined program, an assembling and arranging device for arranging a predetermined number of delivered tiles in a unit tile pack so that the tiles delivered from a plurality of the tiles of different tones of the same color or a plurality of tiles of different color are arranged side by side in lines and rows; a joint correcting unit having longitudinal and transverse joint correcting devices for aligning a plurality of tiles of a tile pack to form longitudinal and transverse joints each having a fixed width between the tiles, the longitudinal joint correcting device comprising stationary friction members and the transverse joint correcting devices comprising transversely movable friction members; an adhesive dropping unit having a plurality of adhesive dropping nozzles disposed at a predetermined interval from the upper surface of the tiles and intermittently dropping a proper quality of liquid adhesive on the upper surface of each of the tiles at positions close to the sides adjacent to those of the adjacent tiles; and a connecting sheet supplying and pressing unit having an air box which shuttles between connecting sheet stock cases and the tile pack conveying passage for supplying connecting sheets sucked from connecting sheet stock cases so that the connecting sheets are placed at positions where the adhesive is dropped, so as to interconnect the adjacent tiles respectively, and for blowing compressed air adjacent to the connecting sheets placed on the tiles to remove air existing between the tile and the connecting sheets in order to securely interconnect the tiles; wherein the combination tile pack forming unit, the joint correcting unit, the adhesive dropping unit, and the connecting sheet supplying and pressing unit are disposed sequentially (one after another) from the tile pack supplying section to the tile pack delivering section along the tile pack conveying passage.

BRIEF DESCRIPTION OF THE DRAWINGS

The present invention will now be described in detail with reference to the accompanying drawings, wherein the same reference numerals are used to designate similar parts throughout the drawings, in which:

FIG. 9 is an illustration of a control program for the control device of FIG. 7;

FIG. 10 is an illustration of combination tile packs formed by the unit of FIG. 7;

DESCRIPTION OF THE PREFERRED EMBODIMENTS

Before describing preferred embodiments of the present invention, an explanation is given of the conventional apparatuses in the field to which the present invention pertains.

Figure 11:
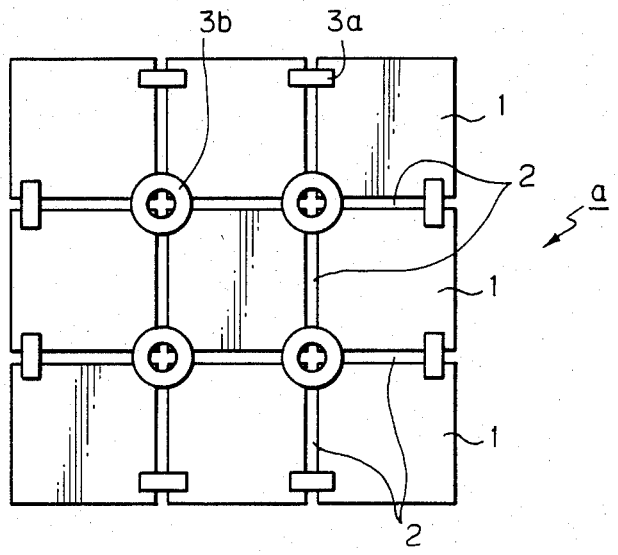
FIGS. 11 and 12 are plan views of unit tile packs in which a plurality of tiles are interconnected by connecting sheets.
Figure 12:
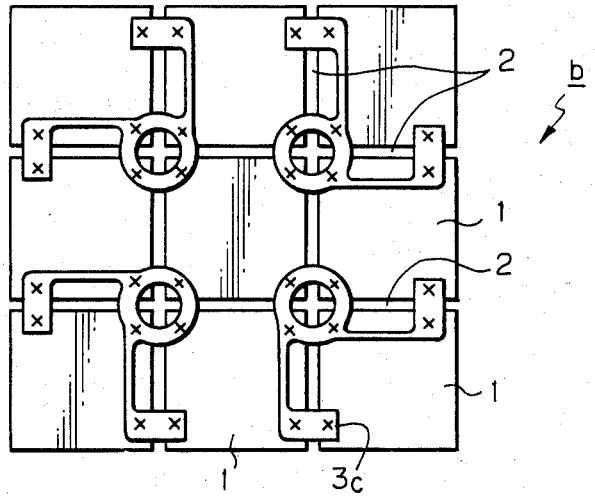

A conventional tile pack manufacturing apparatus for manufacturing the unit tile pack a as illustrated in FIG. 11 and a conventional unit tile pack manufacturing apparatus for manufacturing the unit tile pack b as illustrated in FIG. 12 each comprises mechanisms including an adhesive applying unit (not shown) and a connecting sheet supplying unit (not shown) disposed along the tile conveying direction of a tile conveying passage (not shown). The adhesive applying unit applies an adhesive over the upper surface or on part of the upper surface of each of tiles 1 aligned with joints 2 therebetween. The connecting sheet supplying unit supplies connecting sheets to the tiles 1 at positions where the adhesive is applied in order to interconnect the adjacent tiles 1.

Figure 13:
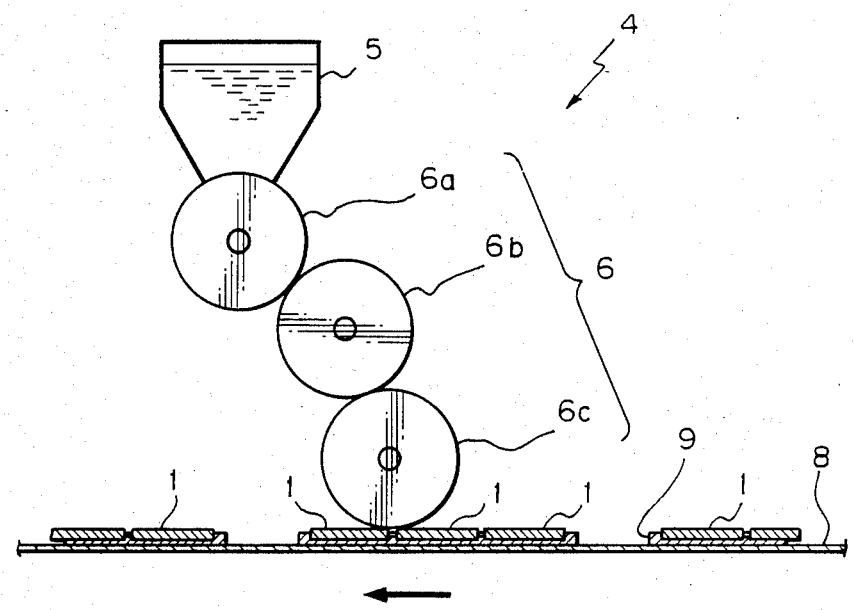
FIG. 13 is a schematic sectional side elevation of a conventional adhesive applying mechanism.

In such a conventional unit tile pack manufacturing apparatus, the various problems that occur usually originate in the adhesive applying unit, and hence, the adhesive applying unit is a source of undesirable stoppages in the flow of the tile pack manufacturing line. The conventional adhesive applying unit will now be described. FIG. 13 shows a schematic sectional elevation of an example of a conventional adhesive applying unit indicated generally at 4. As illustrated in the drawing, the adhesive applying unit 4 comprises an adhesive tank 5, and a roller group 6 including a plurality of rollers **6*a*, 6*b*, and 6*c* extended in parallel to each other under the adhesive tank 5. Namely, the roller group 6 includes a metering roller 6*a* disposed contiguously to the adhesive tank 5, a spreading roller 6*b* disposed next to the metering roller 6*a*, and an application roller 6*c* disposed next to the spreading roller 6*b*. A plurality of tiles 1 are conveyed along tile conveying passage 8 in a pallet 9 having tile receiving pockets for holding the tiles 1 in alignment. The application roller 6*c* of the adhesive applying unit 4 comes into contact with the entire area of the surface of each one of the tiles 1 aligned in the tile receiving pockets for holding the tiles 1 in alignment. The application roller 6*c* of the adhesive applying unit 4 comes into contact with the entire area of the surface of each one of the tiles 1 aligned in the tile receiving pocket to apply an adhesive to the surfaces of the tiles 1. However, since tiles are manufactured through a plurality of heating processes having different temperature levels, such as burning and drying, errors in the size of the tiles, including thickness, occur. Therefore, when tiles 1 are disposed in place in the pallet 9, the upper surfaces of the tiles are not flush and form an irregular plane. Accordingly, each of the tiles 1 comes into contact with the application roller 6*c* to a varying degree, and hence it is impossible to apply the adhesive to the surfaces of the tiles 1 as a film having a uniform thickness. Furthermore, the size of the tile receiving pockets of the pallet 9 is slightly greater than the maximum external size of the tiles 1, to enable a more efficient mounting of the tiles 1 on the pallet 9. Accordingly, the tiles 1 are disarranged, i.e., improperly edge-aligned, when the adhesive is applied to the upper surfaces of the tiles 1 by the application roller 6c. Therefore, in the conventional unit tile packet manufacturing process, it is necessary to check and correct the arrangement of the tiles 1** both before and after the application of the adhesive.

Figure 14:
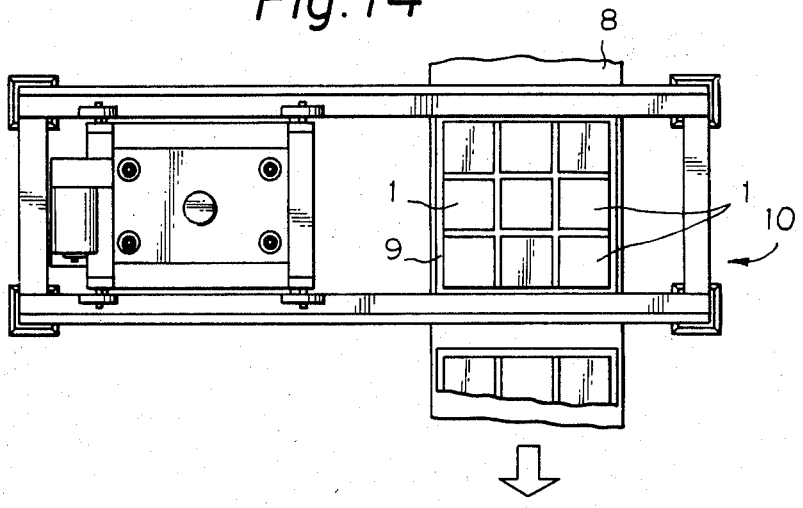
FIG. 14 is a plan view of another conventional adhesive applying mechanism.
Figure 15:
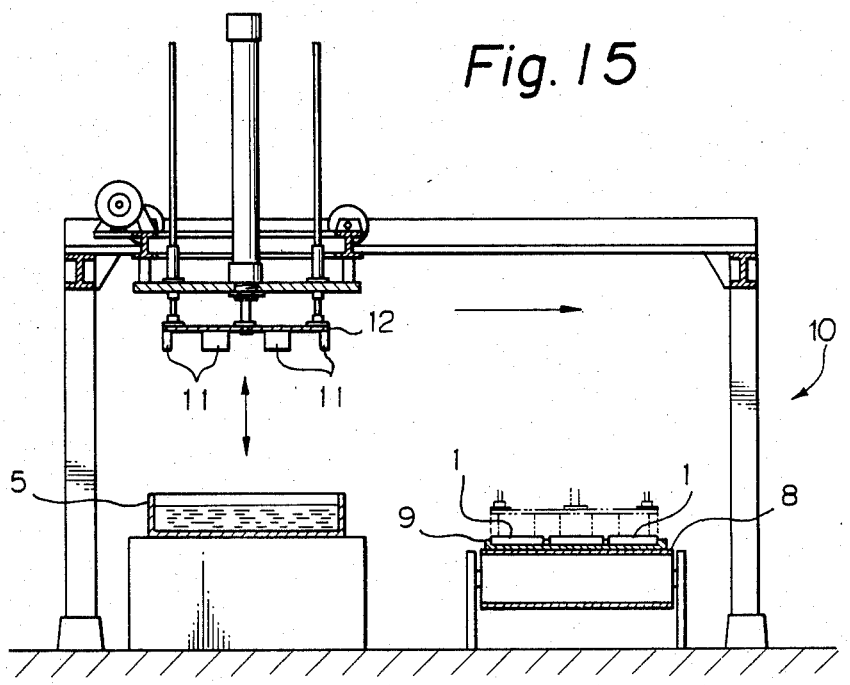
FIG. 15 is a sectional front elevation of the mechanism of FIG. 14.

To eliminate such a drawback, an adhesive applying mechanism 10 as illustrated in FIGS. 14 and 15 was developed. FIG. 14 and 15 show a plan view and a sectional front view, respectively, of the adhesive applying mechanism 10. The adhesive applying mechanism 10 has a lifting board 12 capable of moving vertically in an area above a tile conveying passage 8 and in an area above an adhesive tank 5 disposed beside the tile conveying passage 8. Adhesive transferring members 11 formed by a vibration-absorbing material such as sponge or the like are attached to the underside of the lifting board 12. The adhesive applying mechanism 10 applies an adhesive to the tiles 1 by absorbing he adhesive contained in the adhesive tank 5 by the adhesive transferring members 11, and then bringing the adhesive transferring members 11 into contact with a tile pack, after moving the tile pack on the tile conveying passage 8, to transfer the adhesive from the adhesive transferring members 11 to the tiles of the tile pack. However, this adhesive applying mechanism 10 still must apply an adhesive to the tiles 1 through contact of the adhesive transferring members 11 with the tiles 1, and thus this adhesive applying mechanism 10 is unable to eliminate all of the drawbacks of the above-mentioned adhesive applying unit 4 (FIG. 13). Furthermore, since the surface of the adhesive contained in the adhesive tank 5 of the adhesive applying mechanism 10 is exposed to the atmosphere, this adhesive applying mechanism 10 has another drawback in that the surface of the adhesive contained in the adhesive tank 5 hardens. Still further, as apparent from FIG. 15, since the adhesive tank 5 must be disposed beside the tile conveying passage 8, the adhesive applying mechanism requires a wide floor space for the installation thereof. Furthermore, the tile conveying passage 8 must be stopped while the lifting board 12 moves between the adhesive tank 5 and the tile conveying passage 8, and therefore, the overall operating efficiency of the unit tile pack manufacturing apparatus including this adhesive applying mechanism is extremely low.

Figure 1:
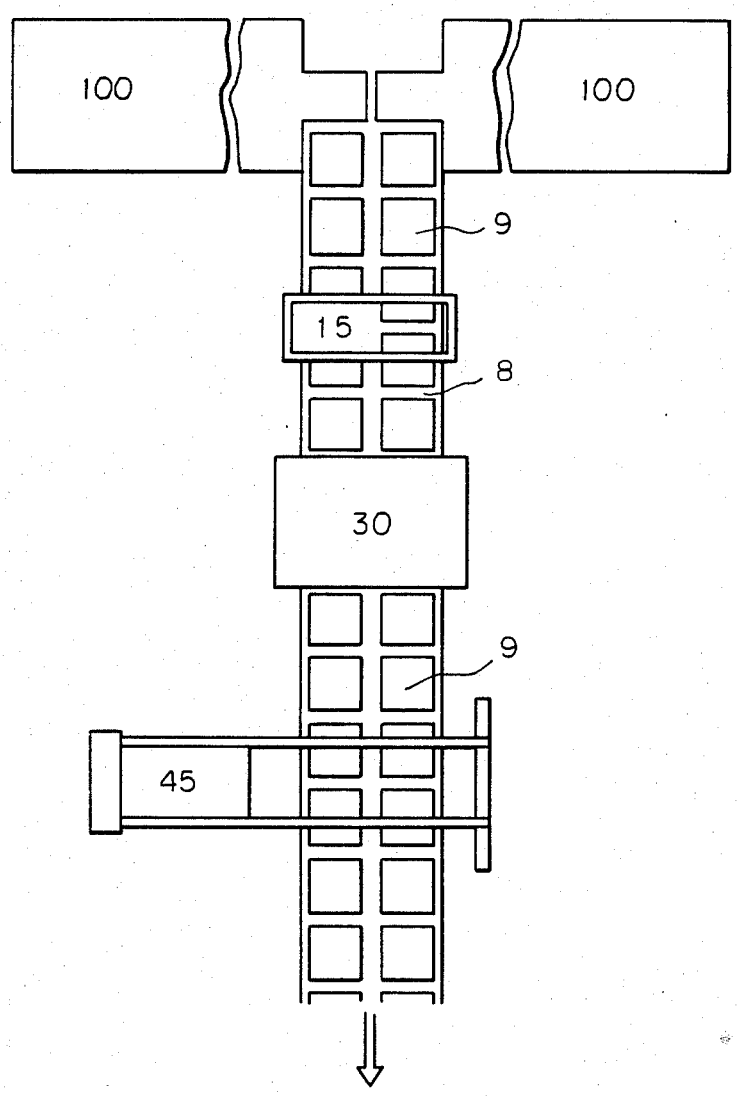
FIG. 1 is diagramatic plan view of the combination unit tile pack manufacturing apparatus according to the present invention.

The preferred embodiment of the present invention will now be described. As illustrated in FIG. 1, the unit tile pack manufacturing apparatus of the present invention comprises a tile pack conveying passage 8 for conveying a plurality of pallets 9, two sets of combination tile pack forming units 100, a joint correcting unit 15, an adhesive dropping unit 30, and a connecting sheet supplying and pressing unit 45. These component units are disposed along the tile pack conveying passage 8.

Figure 2:
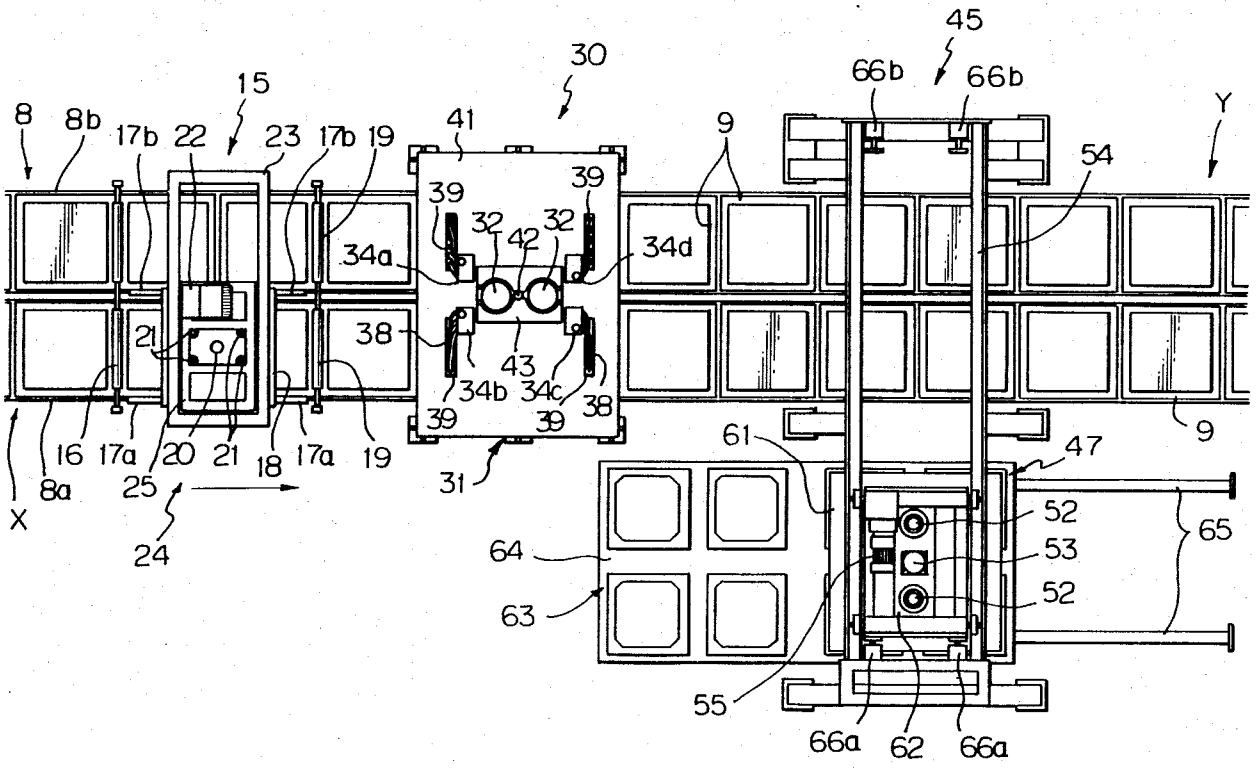
FIG. 2 is a plan view of the apparatus of the present invention, in which a pair of combination tile pack forming units are omitted.

FIG. 2 is a plan view of an apparatus of the present invention, in which the above mentioned combination tile pack forming units 100 are omitted to clarify the drawing.

As illustrated in FIG. 2, the apparatus of the present invention comprises a joint correcting unit 15, an adhesive dropping unit 30, and a connecting sheet supplying and pressing unit 45. These component units are disposed sequentially (one after another) from a tile pack supplying section X toward a unit tile pack delivering section Y along a tile conveying passage 8 in the direction of travel thereof, shown by an arrow. Namely, in this embodiment, the tile conveying passage 8 comprises two parallel conveyor belts 8a and 8b, and the above component units are adapted to simultaneously process two tile packs arranged sequentially on the conveyor belts 8a and 8b. That is, each of the above component units processes four tile packs in a single operation cycle. In the tile conveying passage 8, the tile pack supplying section X is an input section where tiles are aligned in a pallet 9 having a plurality of tile receiving packets with the top or back sides of the tiles all facing up before subjecting the tiles to the following processes for fixing connecting sheets to the tiles, and the unit tile pack delivering section Y is an output section where unit tile packs, in which the tiles are interconnected with connecting sheets, are delivered to the next process at which the unit tile packs are packed for storage or for forwarding. The component units of the apparatus will now be described in detail.

Figure 3:
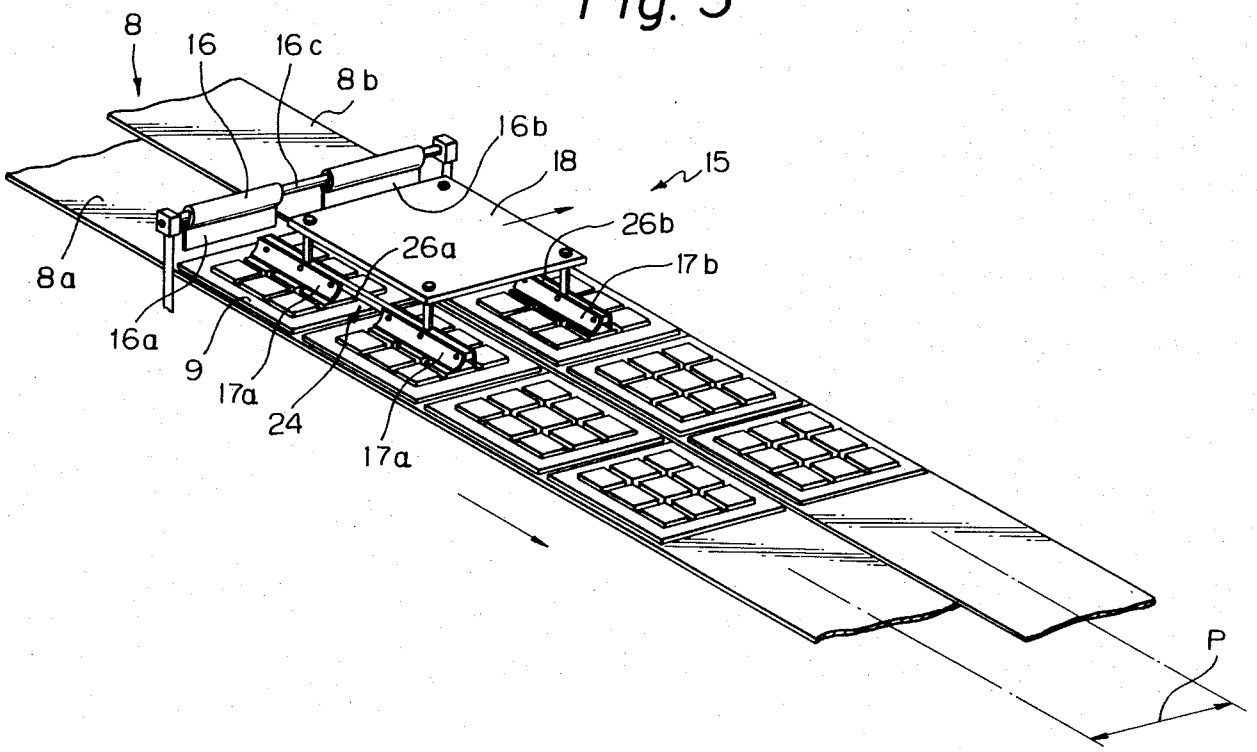
FIG. 3 is an exploded perspective view of a joint correcting unit.

FIG. 3 is an exploded perspective view of the joint correcting unit 15. As illustrated in FIG. 3, the joint correcting unit 15 has a longitudinal joint correcting device 16 and a transverse joint correcting device 24.

The longitudinal joint correcting device 16 corrects longitudinal joints extending perpendicular to the conveying direction, shown by an arrow, of the tile conveying passage 8, and comprises rotary shaft 16c extended across and over the tile conveying passage 8 in the form of a gate, and hard rubber plates 16a and 16b suspended from the rotary shaft 16c. The rubber plates 16a and 16b are disposed in such a manner that the lower ends thereof are in contact with the upper surfaces of the tiles of the conveyed tile packs to drag each tile backward in the pallet 9 conveyed on the tile conveying passage 8.

The transverse joint correcting device 24 corrects transverse joints extending in parallel to the conveying direction, shown by an arrow, of the tile conveying passage 8. The principle of the function of the transverse joint correcting device 24 is the same as that of the longitudinal joint correcting device 16. Hard rubber plates 17a and 17b of the transverse joint correcting device 24 come into contact with the upper surfaces of the tiles of the conveyed tile packs in the direction extending in parallel to the conveying direction of the tile conveying passage 8 so that the tiles are biased toward one side of the pallet 9. Unlike the longitudinal joint correcting device 16, the transverse joint correcting device 24 is unable to make use of the conveying motion of the tile conveying passage 8. Accordingly, the transverse joint correcting device 24 has a base board 18 equipped with a lifting mechanism and a running mechanism, not shown in FIG. 3, as a main constituent.

The base board 18 is provided with two suspended shafts 26a and 26b extending in parallel to the conveying direction of the tile conveying passage 8. The suspended shafts 26a and 26b are disposed at an interval equal to the layout pitch P of the conveyor belts 8a and 8b of the tile conveying passage 8. The two hard rubber plates 17a and the two hard rubber plates 17b are attached to the suspended shafts 26a and 26b respectively.

As illustrated in FIG. 2, the lifting mechanism of the transverse joint correcting unit 24 comprises a lifting base frame 25, a pneumatic cylinder 20 having a short stroke, and four guide bars 21 attached to the base board 18, and is adapted to move the base board 18 vertically below the lifting base frame 25. The running mechanism comprises an upper rail 23 disposed so as to extend perpendicularly to the conveying direction of the tile conveying passage 8, and a driving motor 22 for reciprocating the lifting main frame 25 along the upper rail 23, and is adapted to move the base board 18 by a distance corresponding to the layout pitch P of the conveyor belts 8*a* and 8*b* of the tile conveying passage 8. The transverse joint correcting device 24 operates while the conveying motion of the tile conveying passage 8 is stopped, and corrects the transverse joint of the tile pack by the combined actions of the lifting mechanism and the running mechanism.

Figure 4:
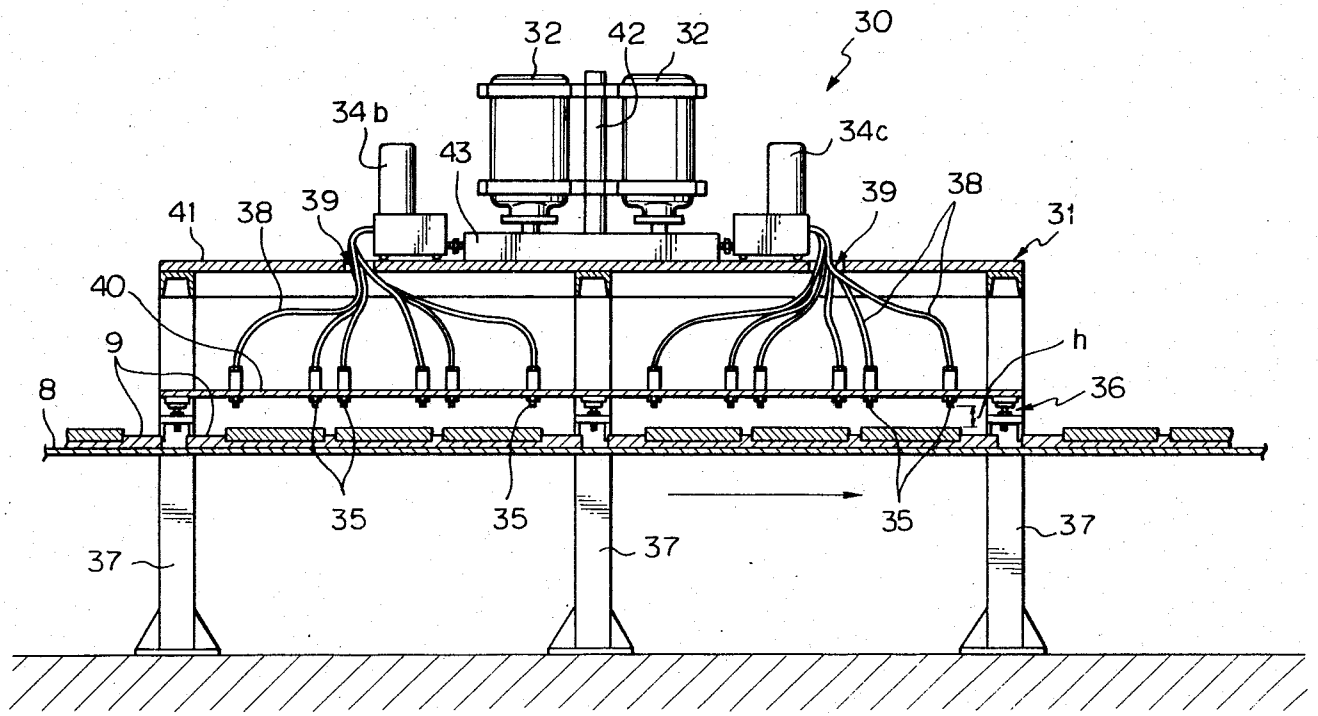
FIG. 4 is a sectional side elevation of an adhesive dropping unit.

FIG. 4 is a sectional side elevation view of the adhesive dropping unit 30. The functions of the adhesive dropping unit 30 of the apparatus of the present invention correspond to the summarized function of the adhesive applying unit 4 (FIG. 13) and the adhesive applying mechanism 10 (FIGS. 14 and 15) of the conventional unit tile packet manufacturing apparatus. As illustrated in FIG. 4, the adhesive dropping unit 30 is mounted on a stand 31 extending across the tile conveying passage 8, and comprises a plurality of adhesive dropping nozzles 35, adhesive tanks 32, and measuring and feeding devices 34*a*, 34*b* 34*c*, and 34*d* (FIG. 2).

The adhesive dropping nozzles 35 are attached to and penetrate a middle plate 40 of the stand 31 and are disposed at positions corresponding to the adjacent sides, respectively, of the upper surfaces of the adjacent tiles of a fixed number of tile packs conveyed below the adhesive dropping nozzles 35. More concretely, when manufacturing a unit tile pack as illustrated in FIG. 12, for example, the adhesive dropping nozzles 35 are disposed at positions corresponding to positions indicated by the marks "x" in FIG. 12.

The adhesive tanks 32 are held by a supporting bar 42 held upright on a top plate 41 of the stand 31. The outlets of the adhesive tanks 32 are inserted in a manifold 43 disposed below the adhesive tanks 32 so that the adhesive contained therein is completely isolated from the atmosphere. The manifold 43 receives the adhesive from the two adhesive tanks 32 and distributes this adhesive to the four measuring and feeding devices 34*a* to 34*d*.

Feed pipes 38 for the adhesive are connected to the measuring and feeding devices 34*a* to 34*d*. The measuring and feeding devices 34*a* to 34*d* intake the adhesive contained in the adhesive tanks 32 and feed this adhesive intermittently at a fixed rate to the adhesive dripping nozzles 35. The measuring and feeding devices 34*a* to 34*d* and the adhesive dropping nozzles 35 are interconnected by the feed pipes 38 extending through slots 39 formed in the top plate 41 of the stand 31. Thus a predetermined quantity of the adhesive is dropped intermittently from each adhesive dropping nozzle 35.

Adjusting devices 36 for adjusting the level of the middle plate 40 are provided inside the respective legs 37 of the stand 31, which enables the distance h between the adhesive dropping nozzles 35 and the upper surfaces of the tiles of the tile packs to be adjusted. It was found through experiments performed by the inventors of the present invention that an optimum value of the distance h is about 20 mm.

Figure 5:
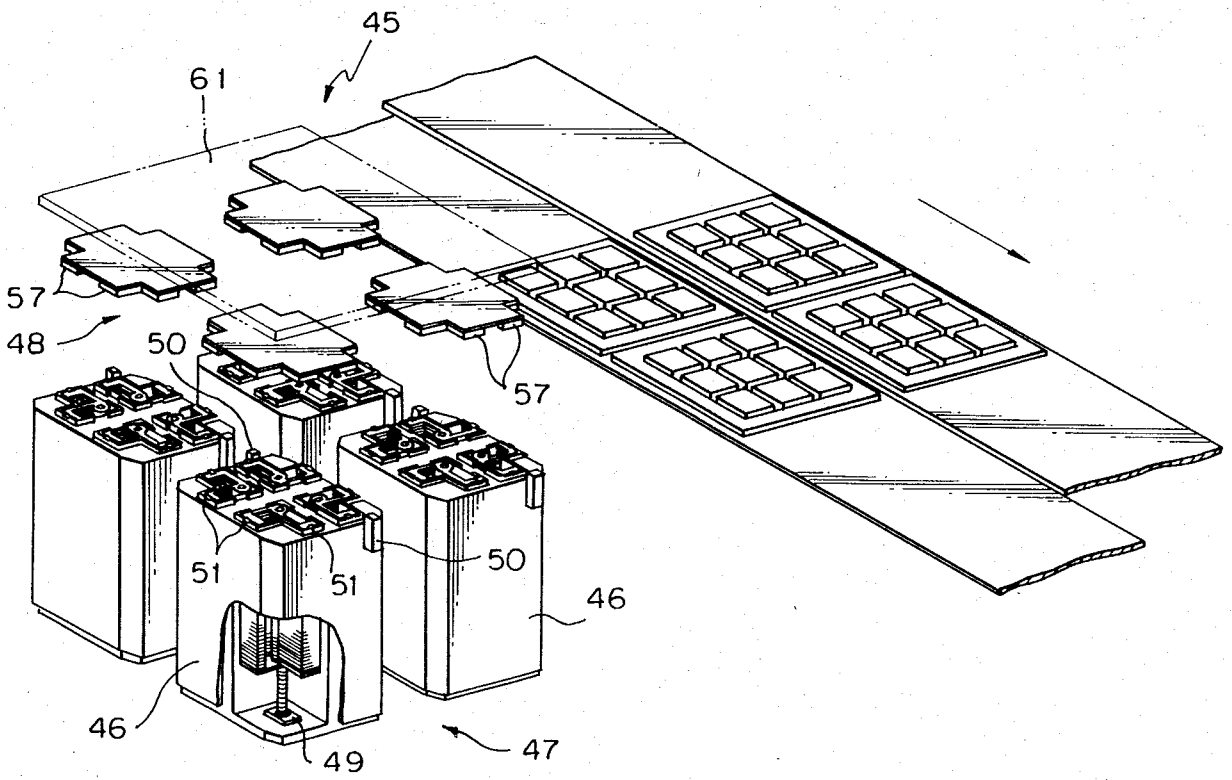
FIG. 5 is an exploded view of a connecting sheet supplying and pressing unit.

FIG. 5 is an exploded perspective view of the connecting sheet supplying unit 45. As illustrated in FIG. 5, the connecting sheet supplying and pressing unit 45 comprises a stock case group 47 disposed beside the tile conveying passage 8, and a connecting sheet transporting device 48 which shuttles between the stock case group 47 and the tile conveying passage 8.

The stock case group 47 is an assembly of a plurality of stock case 46 (four stock cases in this embodiment). The stock case 46 stocks piles of connecting sheets so as to meet connecting sheet fixing conditions including the number of connecting sheets to be fixed to each tile pack having a predetermined number of tiles, disposition of each connecting sheet, fixing position, and the like. Each pile of connecting sheets can be lifted in the stock case 46 by a motor, not shown, having a linear head 49 or the like. The lifting of the pile of the connecting sheets is controlled by transmissive photoelectric tubes 50, in such a manner that the upper surface of the pile is always held at a fixed level. Brushes 51 for separating the connecting sheets of the pile of the connecting sheets into individual connecting sheets are provided on the upper surface of the stock case 46.

Figure 6:
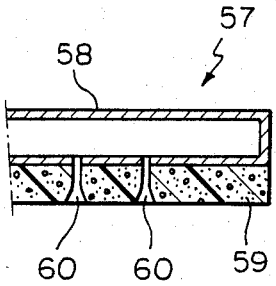
FIG. 6 is an enlarged exploded view of an air box employed in the connecting sheet supplying and pressing unit.
Figure 7:
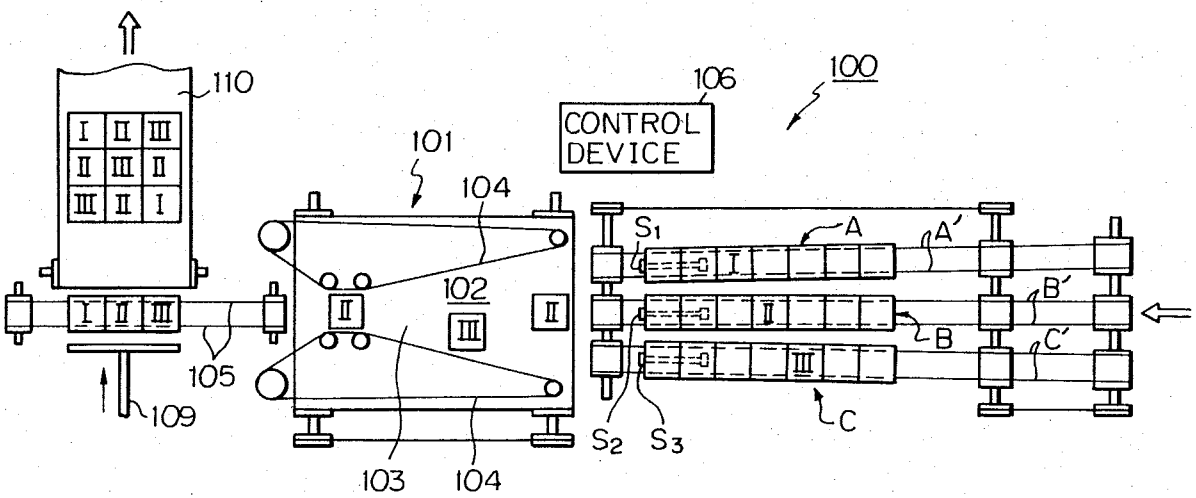
FIG. 7 is a plan view of a combination tile pack forming unit.

The connecting sheet transporting device 48 comprises, as the main components thereof, a base board 61 equipped with a lifting mechanism and a running mechanism. A plurality of air boxes 57 for sucking or jetting air are provided on the underside of the base board 61. FIG. 7 is an enlarged exploded sectional view of the air box 57. As illustrated in FIG. 6, the air box 57 has a hollow box 58 and a porous plate 59 formed by sponge or the like fixed to the underside of the hollow box 58. A plurality of air holes are formed through the porous plate 59 and the bottom wall of the box 58. Although not illustrated, the boxes 58 are connected to a suitable pump or the like, to jet compressed air at a pressure 5 to 8 kg/cm$^2$ to suck air at a predetermined pressure.

The respective constructions of the lifting mechanism and the running mechanism of the connecting sheet transporting device 48 are the same as those of the transverse joint correcting unit 24, as illustrated in FIG. 2. That is, the lifting mechanism is designed to move the base board 61 vertically below a lifting base frame 62 mounted with a pneumatic cylinder 53 and two guide bars 52. The running mechanism comprises upper rails 54 extended perpendicularly to the conveying direction, shown by an arrow, of the tile conveying passage 8, and a driving motor 55 for reciprocating the lifting base frame 62 along the upper rails 54. The base board 61 is shuttled between a position above the stock case group 47 and a position above the conveyor belts 8*a* and 8*b*. Shock absorbers 66*a* and 66*b* for the lifting base frame 62 are provided at the respective opposite ends of the upper rails 54.

All of the component mechanisms of the connecting sheet supplying and pressing unit 45 serve as component mechanisms of the connecting sheet pressing unit, in which the air box 57 of the unit 45 is a main component. That is, the unit 45 jets compressed air of 5 to 8 kg/cm$^2$ through the air holes 60 against the connecting sheets placed on the tiles so that the connecting sheets are extended over he adjacent tiles, to firmly interconnect these adjacent tiles. The compressed air is jetted most effectively against the connecting sheets when the height from the upper surface of the connecting sheets to the underside of the porous plate is about 10 mm. The air jetting action of the connecting sheet pressing unit 45 functions as a negative pressure breaker (also designated a "vacuum breaker") for canceling the suction of the air box 57 used to attract the connecting sheets.

Various embodiments of the apparatus of the present invention are possible, since there are no restrictions regarding the construction of the tile conveying passage. For example, the tile conveying passage may be constituted by roller conveyors.

The individual requirements for the components constituting the apparatus of the present invention will now be described.

(1) Tiles

Tiles may be those used for either interior finish or exterior finish, and number of tiles in a tile pack is optional. There are no restrictions on the shape and number of the connecting sheets, and the connecting sheets may be fixed on surface or back surface (back foot forming sides) of the tiles.

(2) Joint Correcting Unit 15

If an accurate correction of the alignment of the joints of the tile pack is not absolutely necessary, the longitudinal joint correcting device 16 need not be operated, and only the transverse joint correcting device 24 used for correcting the alignment of the joints. Namely, when the transverse joint correcting device 24 is operated while the tile conveying passage 8 is operating, the tiles received on the pallet 9 can be dragged diagonally backward, so that both the longitudinal joints and the transverse joints are corrected. Conversely, when a highly accurate correction of the alignment of the required joints is, the longitudinal joints can be corrected again after the correction of the transverse joints of the tile pack, by an additional longtitudinal joint correcting device 19 disposed following the transverse joint correcting device 24, and thereby joint correction can be carried out more effectively.

(3) Adhesive Dropping Unit 30

The adhesive dropping unit 30 may be of any type of mechanism provided that the mechanism is capable of feeding an adhesive in fixed quantities.

(4) Connecting Sheet Supplying and Pressing Unit

As illustrated in FIG. 2, the disposition of a spare stock case group 63 beside the stock case group 47 of the connecting sheets so as to be movable in parallel to the conveying direction (shown by an arrow) of the tile conveying passage 8 enables the loading and preparation of the stock case group 63 during the use of the stock case group 47, which remarkably facilitates the operation. In this case, it is preferable to utilize a cart 64 mounted with the stock case groups 47 and 63 and shuttling on rails 65 laid on the floor of the plant.

The connecting sheet pressing member may be a separate unit provided in addition to the connecting sheet supplying member. As is apparent from the above description, the constitution of the details and the morphology of the parts of the apparatus of the present invention are suitably changeable according to the mode of application of the present invention.

In addition, obvious from the above description hereinbefore, the novel adhesive dropping unit employed in the unit tile pack manufacturing apparatus according to the present invention completely eliminates the problems in the conventional adhesive applying mechanisms, and hence the overall efficiency of the unit tile pack manufacturing apparatus is very much improved. Furthermore, compared with the conventional adhesive applying mechanism, the adhesive dropping unit of the apparatus of the present invention has many original advantages. That is, the adhesive dropping unit is constructed so as to feed an adhesive to the tiles without touching the upper surface of the tiles, and hence the alignment of the tiles conveyed on the tile conveying passage will not be disarranged. Furthermore, since the adhesive tanks containing the adhesive are closed to the atmosphere, except for the outlets thereof which are inserted into the manifold to completely isolate the adhesive contained in the adhesive tanks from the atmosphere, the adhesive cannot harden before being applied to the tiles. Still further, this adhesive dropping unit is superior to the conventional adhesive applying mechanism 4 illustrated in FIG. 13 in that it is capable of feeding the adhesive only to desired positions. Furthermore the adhesive dropping unit of the present invention has a remarkable advantage over the conventional adhesive applying mechanism 10 illustrated in FIGS. 14 and 15 in that it requires the tile conveying passage to be stopped for only extremely short time.

Figure 8:
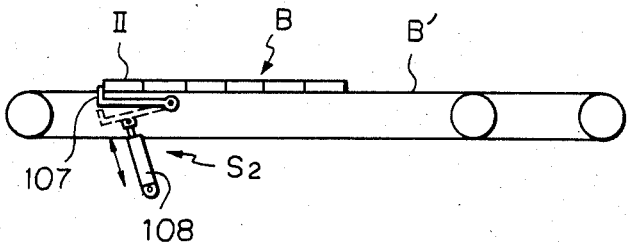
FIG. 8 is a side elevation of an essential portion of the unit of FIG. 7.

FIG. 7 is a plan view of a combination tile pack forming unit 100 according to the present invention, FIG. 8 is a side elevation showing the essential portion of the unit 100 of FIG. 7, and FIG. 9 shows a control program of a control unit included in the apparatus of FIG. 7.

Operation of the unit 100 according to the present invention will be described as applied to forming a unit tile pack 30.3 cm by 30.3 cm consisting of nine tiles arranged in lines and rows with straight longitudinal and lateral joints therebetween.

Tiles of, e.g., three groups A, B, and C of the same color but differing in color tone are conveyed continuously from the right to the left, as viewed in FIG. 7, by parallel horizontal supply conveyors A', B', and C', respectively. (The tiles are classified by color tone, by a colorimetric sorting machine.)

Assume that the tile groups A, B, and C include tiles I having a color tone higher than the standard color tone, tiles II having a color tone equivalent to the standard color tone, and tile III having a color tone lower than the standard color tone, respectively. The respective leading tiles I, II, and III of the tile groups A, B, and C are checked by stopping devices $S_1$, $S_2$, and $S_3$ disposed near the respective front ends of the conveyors A', B', and C', respectively. Therefore, the tiles of the tile groups A, B, and C are lined up contiguously one after another on the supply conveyors A', B', and C', respectively.

A sorting device 101 is disposed near the front ends of the supply conveyors A', B' and C'. The sorting device 101 comprises a wide horizontal mixing conveyor 102 disposed immediately after the front ends of the supply conveyors A', B', and C', and pair of vertical control conveyors 104 disposed above and in close contact with the mixing conveyor 102 so as to form a convergent passage 103 converging toward the front of the mixing conveyor 102. The minimum width of the convergent passage is slightly greater than the width of the individual tile. A horizontal delivery conveyor 105 is disposed immediately after the mixing conveyor 102.

A control device 106 for controlling the stopping devices $S_1$, $S_2$, and $S_3$ is disposed beside the arrangement of the stopping devices. As illustrated in FIG. 8, each of the stopping devices $S_1$, $S_2$, and $S_3$ has a stopper 107 having an L-shaped cross section and pivotally attached at one end thereof to a fixed part below the corresponding supply conveyor and a hydraulic cylinder 108 for turning the stopper 107 clockwise or counterclockwise on its pivot. The hydraulic cylinders 8 are controlled individually by the control device 106.

The control program of the control device 106 will be described with reference to FIG. 9, in which the numerals indicate an example of the operating sequence of the stopping devices $S_1$, $S_2$, and $S_3$ the circular marks indicate stopping device release timings. Thus, at the first timing, the stopping device $S_1$, is released to allow the supply of one high-tone tile I, and then, at the second timing, the stopping device $S_2$ is released to allow the supply of one standard-tone tile II.

The operation of the unit 100 will now be described. As mentioned above, the tiles of the tile groups A, B, and C are checked by the stopping devices on the supply conveyors $A_1$, $A_2$, and $A_3$, respectively. The stoppers 107 are lowered alternately and sequentially according to the control program of the control device 106 to deliver the leading tiles sequentially. The stoppers 107 are raised to check the tiles on the supply conveyors after allowing the leading tiles, to pass respectively.

When the stopping devices are controlled sequentially according to the control program of FIG. 9, the tiles are delivered in the order of tile I, tile II, tile III, tile II, tile III, tile II, tile III, tile II, and tile I, and the same cycle is successively repeated.

The tiles delivered one by one onto the mixing conveyor 102 are arranged in the correct position by the convergent passage 103; the tiles are delivered to the delivery conveyor 105, the tiles are stopped temporarily by a stopper, not shown, as a set of three tiles; and each set of three tiles arranged in a line is they delivered by a shifter 109 in a direction perpendicular to the conveying direction of the delivery conveyor 105 onto an assembling conveyor 110. From the assembly conveyor 110, a plurality of tiles formed as a combination tile pack are conveyed along the tile conveying passage 8 in a pallet 9 having tile receiving pockets for holding the tiles in edge-alignment.

FIG. 10 illustrates combination tile packs each having nine tiles formed through the above-mentioned procedure. As apparent from FIG. 10, in each combination tile pack, the longitudinally and laterally adjacent tiles are different from each other in color tone, and hence in the combination tile pack the different color tones are uniformly distributed. Furthermore, since the standard-tone tiles II of the adjacent combination tile packs are disposed adjacent to each other when the combination tile packs are arranged over a wide area, any color irregularity becomes inconspicuous.

The mechanism of the control unit may be either electrical or mechanical. Essentially, the control device may be any type, provided that the control device is able to control the three stopping devices $S_1$, $S_2$, and $S_3$ sequentially according to a predetermined control program. The stopper need not necessarily be a stopper which engages the front side of the tile to stop the tile: It is possible to stop the tile by clamping the tile at the opposite side edges or by applying pressure to the back of the tile. The number of tiles constituting the combination tile pack is not limited to nine; the combination tile pack may, for example, consist of one hundred 3 cm-square tiles.

It is also possible to apply the principle of the present invention to combining tiles of different colors in a combination tile pack, instead of combining the tiles I, II, and III differing in color tone in a combination tile pack, in order to produce a conspicuous pattern.

The above unit according to the present invention is able to achieve an automatic mixing of tiles and to reduce labor by means of an simple apparatus. The above unit also is able to make a general irregularity in color tone of a wide tile-covered surface inconspicuous when combination tile packs are applied to the wide surface, by selecting an optional control program for the control unit.

We claim:

1. Unit tile pack manufacturing apparatus comprising:

a tile pack conveying passage having a tile pack supplying section at one end and a unit tile pack delivering section at the other end;

a plurality of pallets each having tile receiving pockets for holding a plurality of tiles in a relatively loose fashion and being conveyed along said tile pack conveying passage;

a combination tile pack forming unit having a classifying device for classifying a plurality of tiles of different tones of the same color or a plurality of different colors into a plurality of groups by tone or plurality of groups by color, a delivery device for delivering tiles from each group to a feeding device in order according to a predetermined program, an assembling and arranging device for arranging a predetermined number of delivered tiles in a unit tile pack so that the tiles delivered from a plurality of tiles of different tone of the same color or a plurality of tiles of different color are arranged side by side in lines and rows;

a joint correcting unit having longitudinal and transverse joint correcting devices for aligning a plurality of tiles of a tile pack to form longitudinal and transverse joints each having a fixed width between said tiles, said longitudinal joint correcting device comprise stationary friction members and said transverse joint correcting devices comprise transversely movable friction members;

an adhesive dropping unit having a plurality of adhesive dropping nozzles disposed at a predetermined interval from the upper surface of the tiles and intermittently dropping a proper quality of liquid adhesive on the upper surface of each of said tiles at each of positions close to the sides adjacent to those of the adjacent tiles; and a connecting sheet supplying and pressing unit having an air box which shuttles between connecting sheet stock cases and the tile pack conveying passage for supplying connecting sheets sucked from connecting sheet stock cases so that the connecting sheets are placed at positions where the adhesive is dropped, so as to interconnect the adjacent tiles respectively, and for blowing compressed air adjacent to the connecting sheets placed on said tiles to remove air existing between the tiles and the connecting sheets in order to securely interconnect said tiles;

wherein said combination tile pack forming unit, said joint correcting unit, said adhesive dropping unit, and said connecting sheet supplying and pressing unit are disposed sequentially, one after another, from said tile pack supplying section to said tile pack delivering section along said tile pack conveying passage.

* * * * *